US012799880B2

(12) United States Patent
Okado et al.

(10) Patent No.: US 12,799,880 B2
(45) Date of Patent: Nov. 17, 2026

(54) INTERNAL COMBUSTION ENGINE FOR VEHICLE AND VEHICLE

(71) Applicant: KAWASAKI MOTORS, LTD., Akashi (JP)

(72) Inventors: Sho Okado, Akashi (JP); Ayumi Hamada, Akashi (JP)

(73) Assignee: KAWASAKI MOTORS, LTD., Hyogo (JP)

( * ) Notice: Subject to any disclaimer, the term of this patent is extended or adjusted under 35 U.S.C. 154(b) by 259 days.

(21) Appl. No.: 18/758,931

(22) Filed: Jun. 28, 2024

(65) Prior Publication Data

US 2026/0002455 A1 Jan. 1, 2026

(51) Int. Cl.
*F01M 1/02* (2006.01)
*F01M 11/00* (2006.01)

(52) U.S. Cl.
CPC ..... *F01M 1/02* (2013.01); *F01M 11/0004* (2013.01); *F01M 2011/005* (2013.01)

(58) Field of Classification Search
CPC . F01M 1/02; F01M 11/0004; F01M 2011/005
See application file for complete search history.

(56) References Cited

U.S. PATENT DOCUMENTS 4,703,725 A * 11/1987 Weertman ..... F16F 15/265 123/192.2
6,394,058 B2 * 5/2002 Fegg ..... F01M 9/06 123/196 R

FOREIGN PATENT DOCUMENTS

CN 105937580 A * 9/2016 ..... F01M 1/02
CN 116877226 A * 10/2023 ..... F01M 11/0004
JP 2015113784 A 6/2015
JP 2016151299 A * 8/2016 ..... F02B 67/06

* cited by examiner

*Primary Examiner* — Drew J Brown
(74) *Attorney, Agent, or Firm* — Wenderoth, Lind & Ponack, L.L.P.

(57) ABSTRACT

An internal combustion engine for a vehicle includes: a crankshaft; a balancer shaft that is connected to the crankshaft and configured to be rotated by rotational power transmitted from the crankshaft; a crankcase including a crank chamber that accommodates the crankshaft and the balancer shaft; and a filler that fills a space around the balancer shaft in the crank chamber and is a member different from a wall surrounding the crank chamber.

10 Claims, 5 Drawing Sheets

INTERNAL COMBUSTION ENGINE FOR VEHICLE AND VEHICLE

BACKGROUND ART

Field of the Invention

The present disclosure relates to an internal combustion engine for a vehicle and a vehicle.

Description of the Related Art

Japanese Patent Application Publication No. 2015-113784 discloses a vehicle engine in which a crankshaft and a balancer shaft located in front of the crankshaft are included in a crank chamber. The crankshaft is connected to the balancer shaft through gears, and power of the crankshaft is transmitted to the balancer shaft.

The crankshaft rotates while stirring oil in the crank chamber. However, the balancer shaft may become a stirring resistance, and this may influence the output of the engine.

SUMMARY OF THE INVENTION

An object of one aspect of the present disclosure is to provide an internal combustion engine for a vehicle and a vehicle, each of which reduces a stirring resistance of oil in a crank chamber.

An internal combustion engine for a vehicle according to one aspect of the present disclosure includes: a crankshaft; a balancer shaft that is connected to the crankshaft and is rotated by rotational power transmitted from the crankshaft; a crankcase including a crank chamber that accommodates the crankshaft and the balancer shaft; and a filler that fills a space around the balancer shaft in the crank chamber and is a member different from a wall surrounding the crank chamber.

BRIEF DESCRIPTION OF THE DRAWINGS

The above object, other objects, features, and advantages of the present disclosure will be made clear by the following detailed description with reference to the attached drawings.

DETAILED DESCRIPTION

Hereinafter, an exemplary embodiment of the present disclosure will be described with reference to the drawings. The embodiment described below is a comprehensive or specific example. Among components in the following embodiment, components that are not recited in independent claims which embody the broadest concept of the present disclosure will be described as optional components. The diagrams in the attached drawings are schematic diagrams and are not necessarily strictly drawn. In the diagrams, the same reference signs are used for the substantially identical components, and the repetition of the same explanation may be avoided, or such explanation may be simplified.

Figure 1:
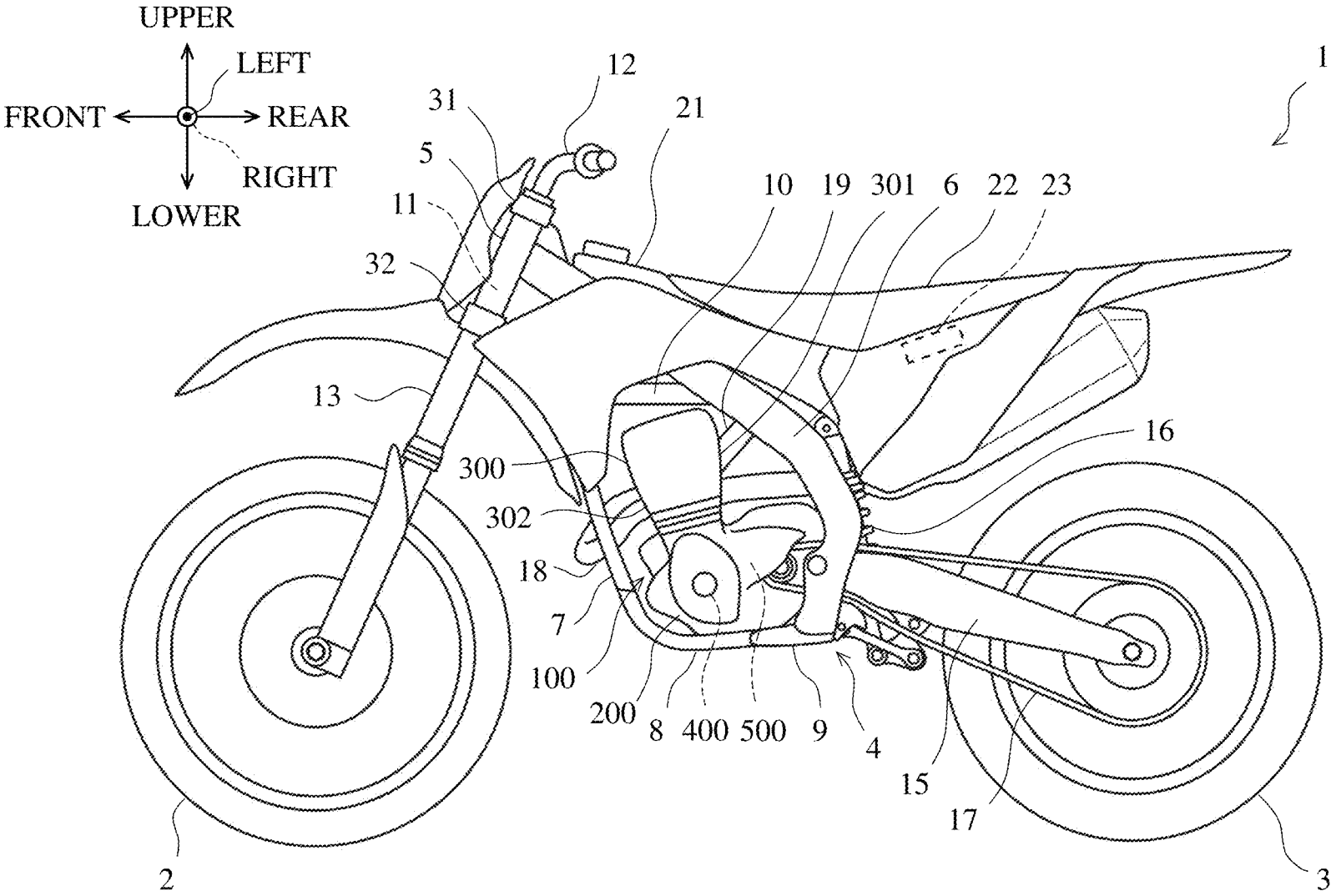
FIG. 1 is a side view showing one example of the configuration of a vehicle according to an exemplary embodiment.

A vehicle 1 according to the exemplary embodiment will be described with reference to FIG. 1. FIG. 1 is a side view showing one example of the configuration of the vehicle 1 according to the exemplary embodiment. In the present embodiment, the vehicle 1 is a motorcycle but is not limited to this. Specifically, the motorcycle is a straddled vehicle of a motocross type which can travel on an irregular ground, i.e., the motorcycle is a straddled off-road traveling vehicle. In the following description, the "vehicle 1" may be referred to as a "motorcycle 1."

The motorcycle 1 includes a front wheel 2, a rear wheel 3, and a vehicle body frame 4. As frame elements, the vehicle body frame 4 includes a head pipe 5, a pair of main frames 6 as left and right main frames, a down frame 7, a pair of lower frames 8 as left and right lower frames, a pivot frame 9, and bridge frames 10. In the vehicle body frame 4, the frame elements are joined to each other by welding.

Herein, in the present specification and the claims, an upper direction, upward, a lower direction, downward, a front direction, forward, a rear direction, rearward, a left direction, leftward, a right direction, rightward, a lateral direction, and lateral indicate directions based on the motorcycle 1 located on a horizontal surface. The upper direction and upward indicate a direction from the horizontal surface toward the motorcycle 1. The lower direction and downward indicate a direction from the motorcycle 1 toward the horizontal surface. The front direction and forward indicate an advancing direction of the motorcycle 1. The rear direction, rearward, the left direction, leftward, the right direction, rightward, the lateral direction, and lateral indicate directions with respect to the front direction or forward.

The head pipe 5 is a tubular body including an axis extending in an upper-lower direction. The main frames 6 extend downward and rearward from an upper portion of the head pipe 5. The down frame 7 is located at a forward position relative to the main frames 6 and extends downward and rearward from a lower portion of the head pipe 5. The lower frames 8 extend downward from a lower portion of the down frame 7, curve, and extend rearward. The pivot frame 9 couples rear portions of the main frames 6 and rear portions of the lower frames 8. The bridge frames 10 couple the main frames 6 and the down frame 7 so as to form gussets.

The motorcycle 1 further includes a steering shaft 11 that is in the head pipe 5 and rotatable. An upper bracket 31 and an under bracket 32 are respectively attached to upper and lower portions of the steering shaft 11. The motorcycle 1 further includes: a handlebar 12 attached to the upper bracket 31; and a pair of front forks 13 as left and right front forks including respective upper portions connected to the upper bracket 31 and the under bracket 32. Lower portions of the front forks 13 support the front wheel 2 such that the front wheel 2 is rotatable. A rider turns the handlebar 12 to steer the front wheel 2 through the steering shaft 11 and the front forks 13.

The motorcycle 1 further includes: a swing arm 15 extending in a front-rear direction; and a rear suspension 16 extending in the upper-lower direction. A front portion of the swing arm 15 is supported by the pivot frame 9 such that the swing arm 15 is pivotable. A rear portion of the swing arm 15 supports the rear wheel 3 as a driving wheel such that the rear wheel 3 is rotatable. The rear suspension 16 is connected to the swing arm 15 and the main frames 6.

The motorcycle 1 further includes an internal combustion engine 100. The internal combustion engine 100 is located in a space surrounded by the main frames 6, the down frame 7, the lower frames 8, and the pivot frame 9. The internal combustion engine 100 is fixed to portions of the vehicle body frame 4.

The internal combustion engine 100 includes a crankcase 200 and a cylinder block 300 extending upward from an upper portion of the crankcase 200. In the present embodiment, the cylinder block 300 is a cylinder block for a single cylinder, and one piston is accommodated in one cylinder bore so as to be slidable. However, the present embodiment is not limited to this. The cylinder block 300 includes: an intake port 301 located at a rear portion of the cylinder block 300; and an exhaust port 302 located at a front portion of the cylinder block 300.

The crankcase 200 accommodates: a crankshaft 400 connected to the piston through a connecting rod; and a transmission 500 connected to the crankshaft 400. The transmission 500 is located rearward of the crankshaft 400 and transmits driving power of the crankshaft 400 to the rear wheel 3 through a power transmitting member 17, such as a chain or a belt.

The motorcycle 1 further includes a fuel tank 21 in a space between the pair of main frames 6. The fuel tank 21 is supported by the main frames 6. The motorcycle 1 further includes a seat 22 which is located rearward of the fuel tank 21 and straddled by the rider. The motorcycle 1 further includes an electronic control unit 23 which is located under the seat 22 and controls various components of the motorcycle 1. The electronic control unit 23 is also called an ECU.

The motorcycle 1 further includes: an exhaust pipe 18 connected to the exhaust port 302 of the cylinder block 300; and an intake duct 19 connected to the intake port 301 of the cylinder block 300. The exhaust pipe 18 defines an exhaust passage through which exhaust gas discharged from the exhaust port 302 is discharged to outside air. The intake duct 19 defines an intake passage through which a fuel-air mixture including fuel and outside air for the internal combustion engine 100 is introduced to the cylinder block 300 through the intake port 301.

Figure 2:
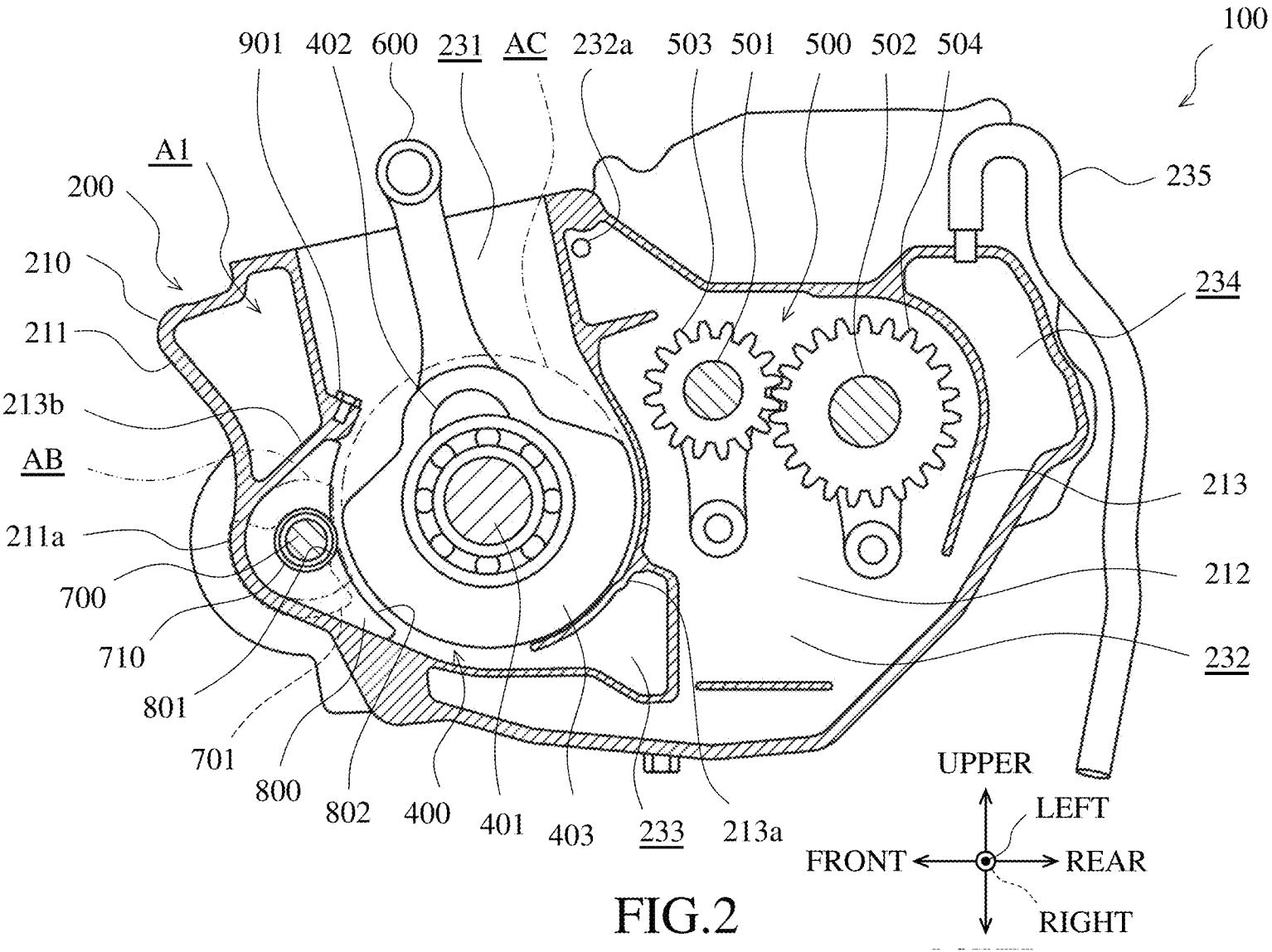
FIG. 2 is a diagram showing a section of an internal combustion engine of FIG. 1.

FIG. 2 is a diagram showing a section of the internal combustion engine 100 of FIG. 1. FIG. 2 is a diagram showing a section of the crankcase 200 along the front-rear direction and the upper-lower direction when viewed from the left side toward the right side. As shown in FIG. 2, the crankcase 200 includes various walls 210. The walls 210 include: an outer wall portion 211 defining an outer shape of the crankcase 200; a first dividing wall portion 212 that divides an inside of the crankcase 200 in the left-right direction; and a second dividing wall portion 213 that extends so as to divide the inside of the crankcase 200 in a direction intersecting with the first dividing wall portion 212.

In the present embodiment, the outer wall portion 211, the first dividing wall portion 212, and the second dividing wall portion 213 are integrated with each other. However, the present embodiment is not limited to this. For example, the crankcase 200 may include a metal material, such as aluminum, as a constituent material, and may be manufactured by casting. For example, the crankcase 200 may have a structure in which the crankcase 200 can be divided along a plane extending along the front-rear direction and the upper-lower direction and respective divided portions of the crankcase 200 are manufactured by casting.

The first dividing wall portion 212 separates a region A1 including a crank chamber 231 in the crankcase 200 and a region not including the crank chamber 231. The region not including the crank chamber 231 is a region adjacent to the region A1 at the left or right side.

The second dividing wall portion 213 separates the crank chamber 231 and an oil sump chamber 232 in the region A1. In the present embodiment, the second dividing wall portion 213 further separates an oil collection chamber 233 communicating with the crank chamber 231 and an air vent chamber 234 communicating with the oil sump chamber 232. However, the present embodiment is not limited to this. The crank chamber 231, the oil sump chamber 232, and the oil collection chamber 233 are supplied with oil that lubricates movable components in the crankcase 200.

The crank chamber 231 accommodates the crankshaft 400 extending in the left-right direction and a connecting rod 600 connected to the crankshaft 400. The crankshaft 400 integrally includes a crank journal 401, a crank pin 402, a crank arm, and a counter weight 403.

The crank journal 401 is located at a rotation center axis of the crankshaft 400 and extends to outsides of the crank chamber 231. The crank pin 402 is eccentric to the crank journal 401 in a radial direction of the rotation center axis and is connected to the connecting rod 600. The crank arm couples the crank journal 401 and the crank pin 402. The counter weight or counter weights 403 is or are connected to one or both of end portions of the crank pin 402 and reduces inertial force generated by the actions of the piston and the connecting rod 600. In the present embodiment, the counter weight 403 may project in the radial direction beyond the crank journal 401 and the crank pin 402. However, the present embodiment is not limited to this. Moreover, the counter weight 403 is integrated with the crank arm to form a plate-shaped crank web that also serves as the crank arm. The counter weight 403 may be structured not to serve as the crank arm.

The crank chamber 231 further accommodates a balancer shaft 700 extending in the left-right direction. The internal combustion engine 100 includes the balancer shaft 700 and a pipe 710 surrounding the balancer shaft 700 from an outside. The balancer shaft 700 is connected to the crankshaft 400 and is rotated by rotational power transmitted from the crankshaft 400.

In the present embodiment, the balancer shaft 700 is located at a forward position relative to the crankshaft 400 and extends in the left-right direction. However, the present embodiment is not limited to this. The balancer shaft 700 is located so as not to project downward beyond a below-described occupied region AC of the crankshaft 400. Thus, the projection of the crankcase 200 in the lower direction is suppressed. For example, the balancer shaft 700 extends in parallel with the crankshaft 400. Both ends of the balancer shaft 700 extend to outsides of the crank chamber 231. The balancer shaft 700 includes counter weights 701 at both ends thereof which are located outside the crank chamber 231. The counter weight 701 reduces inertial force generated at the crankshaft 400 that rotates together with the balancer shaft 700.

The pipe 710 extends in the left-right direction in the crank chamber 231 and supports the balancer shaft 700 such that the balancer shaft 700 is rotatable. In the present embodiment, the pipe 710 is located at a forward position relative to the crankshaft 400. However, the present embodiment is not limited to this. The pipe 710 is located so as not to project downward beyond the below-described occupied region AC of the crankshaft 400. Thus, the projection of the crankcase 200 in the lower direction is suppressed. The pipe 710 may include a bearing that supports the balancer shaft 700. One or both of ends of the pipe 710 may extend to an outside of the crank chamber 231.

The crank chamber 231 includes the occupied region AC of the crankshaft 400 and an occupied region AB of the balancer shaft 700. The crank chamber 231 includes the occupied region AB located forward of the occupied region AC, and therefore, has such a shape as to project forward beyond the occupied region AC.

The occupied region AC is a region through which the counter weight 403 and the crank pin 402 pass by the rotation of the crankshaft 400. Specifically, the occupied region AC is a region including: a region of a trajectory of the movement of the counter weight 403 and the crank pin 402 by the rotation of the crankshaft 400; and a region at a radially inner side of this trajectory.

The occupied region AB is a region including the balancer shaft 700 and the pipe 710. The occupied region AB may include a clearance region by which the outer wall portion 211 and the second dividing wall portion 213 around the pipe 710 are separated from the pipe 710 in the radial direction of the balancer shaft 700.

The crank chamber 231 has such a shape as to partially extend along an outer circumferential portion of the occupied region AC of the crankshaft 400. The outer circumferential portion of the occupied region AC is an outer peripheral portion extending along a rotational direction of the counter weight 403. In the present embodiment, the crank chamber 231 has such a shape as to extend along a rear-lower outer circumferential portion of the occupied region AC.

Therefore, the second dividing wall portion 213 includes an opposing wall portion 213*a* that is opposed to the outer circumferential portion of the occupied region AC and extends along this outer circumferential portion. The opposing wall portion 213*a* extends along the rear-lower outer circumferential portion of the occupied region AC. The opposing wall portion 213*a* may extend while being slightly spaced apart from this outer circumferential portion. The opposing wall portion 213*a* includes a curved surface that is opposed to the outer circumferential portion of the occupied region AC and extends along this outer circumferential portion. Since the outer circumferential portion of the occupied region AC is a cylindrical surface, the above curved surface may include a cylindrical surface or a shape similar to a cylindrical surface. The oil in the crank chamber 231 is stirred by the counter weight 403 and the crank pin 402 by the rotation of the crankshaft 400. Such oil can form a smooth flow between the crankshaft 400 and the opposing wall portion 213*a*.

The oil collection chamber 233 is located below the crank chamber 231 and communicates with the crank chamber 231. In the present embodiment, the oil collection chamber 233 is located at a rearward position relative to the rotation center axis of the crank journal 401 and communicates with the crank chamber 231 at the lower side of the crank chamber 231. The oil in the crank chamber 231 flows down to and collects into the oil collection chamber 233.

The oil sump chamber 232 is located rearward of the crank chamber 231. The oil sump chamber 232 stores the oil. In the present embodiment, the oil sump chamber 232 does not communicate with the crank chamber 231 and the oil collection chamber 233. However, the present embodiment is not limited to this. The oil is sent and received between the oil sump chamber 232 and the crank chamber 231 and between the oil sump chamber 232 and the oil collection chamber 233 by pumping.

The oil sump chamber 232 accommodates the transmission 500. The transmission 500 includes an input shaft 501, an output shaft 502, one or more input gears 503, and one or more output gears 504. In the present embodiment, these components of the transmission 500 are located so as not to project downward beyond the occupied region AC. However, the present embodiment is not limited to this. Thus, the projection of the crankcase 200 in the lower direction is suppressed. The input shaft 501 is connected to the crankshaft 400 and is rotated by rotational power transmitted from the crankshaft 400. One or more input gears 503 are attached to the input shaft 501 and can rotate together with the input shaft 501. One or more output gears 504 are attached to the output shaft 502 and can rotate together with the output shaft 502. The output gear 504 is engaged with the input gear 503 and transmits the rotational power, transmitted through the input gear 503, to the output shaft 502. The output shaft 502 extends to an outside of the crankcase 200 and is connected to the power transmitting member 17 through a sprocket and the like. The output shaft 502 transmits the rotational power, transmitted through the output gear 504, to the rear wheel 3.

The oil stored in the oil sump chamber 232 lubricates the above components of the transmission 500. The oil sump chamber 232 includes a supply port 232*a* at an upper portion thereof. The supply port 232*a* is located at the first dividing wall portion 212 of the oil sump chamber 232.

The air vent chamber 234 is located rearward of the oil sump chamber 232 and communicates with the oil sump chamber 232. An upper portion of the air vent chamber 234 is connected to an air vent pipe 235 located outside the crankcase 200. The air vent chamber 234 can release the air in the oil sump chamber 232 to an outside through the air vent pipe 235. The air vent chamber 234 can suppress an increase in internal pressure of the oil sump chamber 232 by the pressure-feeding of the oil through the supply port 232*a*.

The internal combustion engine 100 further includes a filler 800 that fills a space around the balancer shaft 700 in the crank chamber 231. In the present embodiment, the filler 800 is located at a forward position relative to the rotation center axis of the crank journal 401. However, the present embodiment is not limited to this. The filler 800 is located so as not to project downward beyond the occupied region AC. Therefore, the projection of the crankcase 200 in the lower direction is suppressed. The filler 800 is a member different from the wall 210 surrounding the crank chamber 231. The filler 800 includes a different material from the wall 210 as a constituent material. Specifically, the filler 800 includes a resin material having a lower density than the metal material included in the wall 210. The resin filler 800 can reduce the weight of the internal combustion engine 100 more than when the space around the balancer shaft 700 is filled with the above metal material instead of the filler 800. The resin filler 800 can damp vibrations better than the metal material, and therefore can reduce the vibrations transmitted from the balancer shaft 700 to the wall 210.

The filler 800 has such a shape as to fill a space among the outer wall portion 211 which surround the crank chamber 231, the second dividing wall portion 213 which surround the crank chamber 231, and the balancer shaft 700. Specifically, the filler 800 has such a shape as to fill a space among a portion of the outer wall portion 211 which is located forward of the crank chamber 231, a portion of the second dividing wall portion 213 which is located forward of the crank chamber 231, and the pipe 710. More specifically, the filler 800 has such a shape as to fill a space among a front wall portion 211*a* of the outer wall portion 211 which is located at forward of the crank chamber 231, a front wall portion 213*b* of the second dividing wall portion 213 which is located forward of the crank chamber 231, and the pipe 710. In the present embodiment, the filler 800 has such a shape as to fill all of the above spaces. However, the present embodiment is not limited to this.

Figure 3:
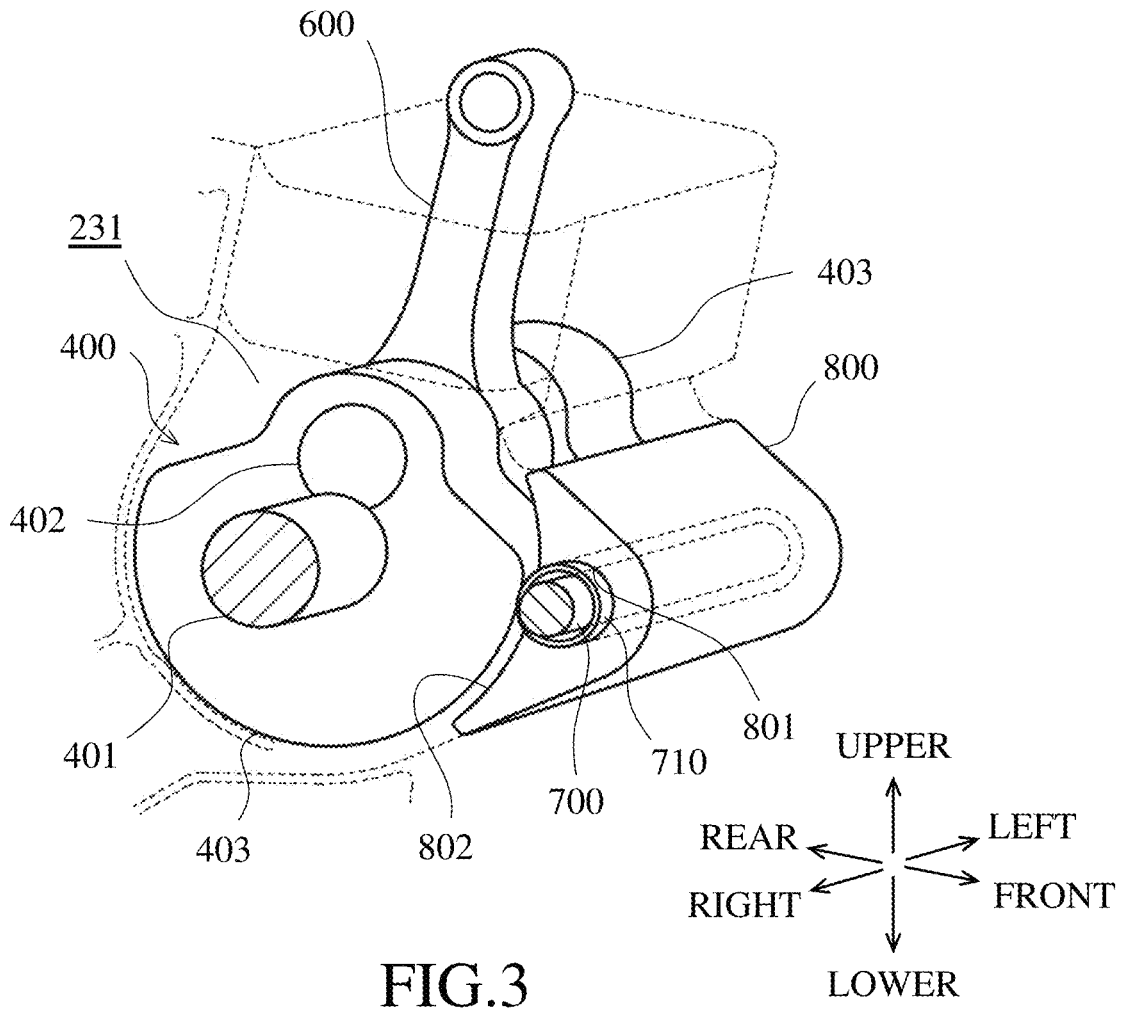
FIG. 3 is a perspective view showing a filler of FIG. 2 and its vicinity.

FIG. 3 is a perspective view showing the filler 800 of FIG. 2 and its vicinity. FIG. 3 is a diagram showing the filler 800 when viewed from the right side to the left side, i.e., in an opposite direction to FIG. 2. In the example of FIG. 3, the pipe 710 extends to outsides of the crank chamber 231. As shown in FIG. 3, the filler 800 has such a shape as to extend in an axial direction of the balancer shaft 700 while surrounding the balancer shaft 700 in a circumferential direction of the balancer shaft 700. Specifically, the filler 800 has such a shape as to surround the balancer shaft 700 in the circumferential direction over the entire length of the balancer shaft 700 in the axial direction in the crank chamber 231. Moreover, the filler 800 has such a shape as to extend in the axial direction of the pipe 710 while surrounding the pipe 710 in the circumferential direction of the pipe 710. Specifically, the filler 800 has such a shape as to surround the pipe 710 in the circumferential direction over the entire length of the pipe 710 in the axial direction in the crank chamber 231. The filler 800 fills the occupied region AB of the balancer shaft 700.

In the present embodiment, the filler 800 includes a through hole 801 into which the pipe 710 can be inserted. However, the present embodiment is not limited to this. The through hole 801 may have an inner diameter equivalent to an outer diameter of the pipe 710. The filler 800 is attached to the pipe 710 and the crank chamber 231 in such a manner that the pipe 710 is inserted into the through hole 801.

Referring back to FIG. 2, the filler 800 may be engaged with the front wall portion 211*a* of the outer wall portion 211 or the front wall portion 213*b* of the second dividing wall portion 213 to be prevented from rotating around the pipe 710. The filler 800 may have such a shape as to fit the surfaces of the front wall portions 211*a* and 213*b*. Thus, the filler 800 may be fitted to the front wall portions 211*a* and 213*b*, and this fitting may prevent the filler 800 from rotating around the pipe 710.

The filler 800 includes a curved surface 802 that is opposed to the outer circumferential portion of the occupied region AC of the crankshaft 400 and extends along this outer circumferential portion. Specifically, the curved surface 802 is located at a rear portion of the filler 800 and faces rearward. The curved surface 802 extends while being opposed to a front portion of the outer circumferential portion of the occupied region AC and extends along this front portion. In the present embodiment, the curved surface 802 extends so as to separate the entirety of a portion of the crank chamber 231, which projects forward from the occupied region AC of the crankshaft 400, from the occupied region AC. However, the present embodiment is not limited to this. Since the outer circumferential portion of the occupied region AC is a cylindrical surface, the curved surface 802 may include a cylindrical surface or a shape similar to a cylindrical surface. The curved surface 802 may extend while being slightly spaced apart from this outer circumferential portion. The curved surface 802 and the opposing wall portion 213*a* of the second dividing wall portion 213 realizes the smooth flow of the oil between the crankshaft 400, the curved surface 802, and the opposing wall portion 213*a*.

In the present embodiment, part of the pipe 710 projects from the curved surface 802. However, the filler 800 may have a shape that surrounds the entire circumference of the pipe 710 such that the pipe 710 does not project from the curved surface 802. Thus, the flow of the oil can be made smoother.

The filler 800 described above may include only one member or may include two or more members. The filler 800 may realize a target shape and a target configuration by assembling two or more members. The filler 800 may have a solid structure or may have a structure including a cavity or a recess. In the latter case, the weight of the filler 800 can be reduced, and the amount of material used for the filler 800 can be reduced.

The internal combustion engine 100 further includes a nozzle 901 located so as to inject the oil, which has been pressure-fed by a pump, into the crank chamber 231. In the present embodiment, the nozzle 901 is directed so as to inject the oil obliquely upward. However, the present embodiment is not limited to this. Specifically, the nozzle 901 is directed so as to inject the oil upward and rearward. The nozzle 901 injects the oil toward an upward area of the occupied region AC of the crankshaft 400. The nozzle 901 is located at an upward position relative to the balancer shaft 700, specifically, at an upward position relative to the filler 800. The nozzle 901 is located at the front wall portion 213*b*, extending at the upper portion of the filler 800, of the second dividing wall portion 213. The nozzle 901 is directed so as to inject the oil in the upper direction that extends along the curved surface 802 of the filler 800. Examples of the direction that extends along the curved surface 802 may include: a direction along a plane obtained by extending the curved surface 802 while maintaining the curvature of the curved surface 802; and a tangential direction of the curved surface 802.

The nozzle 901 can inject the oil in a direction in which the oil stirred by the crankshaft 400 flows. The internal pressure in the crank chamber 231 may increase by the oil injected from the nozzle 901. When the internal pressure increases, the oil may generate a turbulent flow by being stirred by the crankshaft 400. However, since each of the curved surface 802 of the filler 800 and the opposing wall portion 213*a* of the second dividing wall portion 213 has such a shape as to be opposed to the outer circumferential portion of the occupied region AC of the crankshaft 400 and extend along this outer circumferential portion, the oil flows smoothly, and the generation of the turbulent flow of the oil is reduced. Thus, a stirring resistance of the oil received by the crankshaft 400 decreases, and therefore, the output of the internal combustion engine 100 can be improved.

Figure 4:
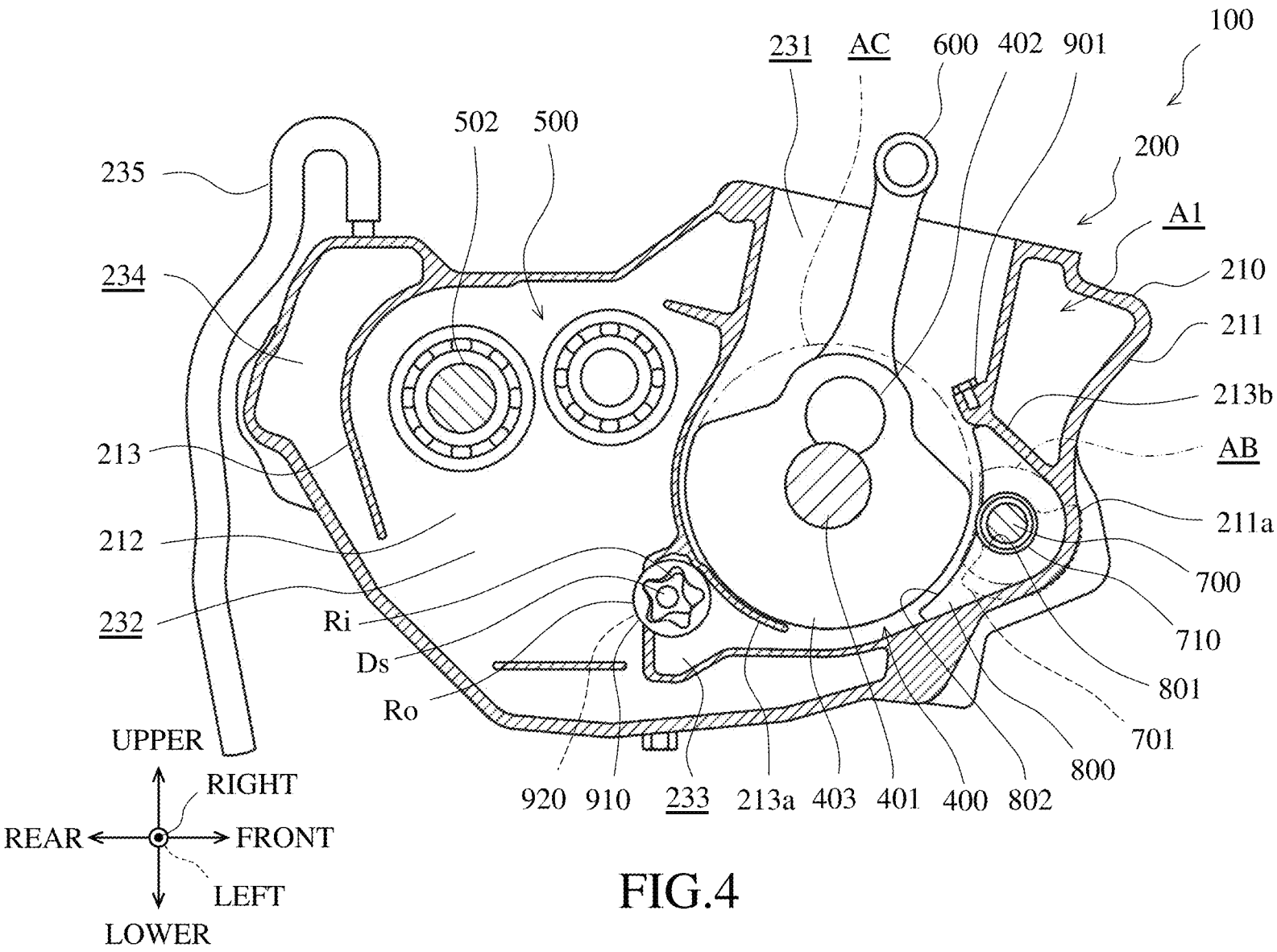
FIG. 4 is a diagram showing another section of the internal combustion engine of FIG. 1.

FIG. 4 is a diagram showing another section of the internal combustion engine 100 of FIG. 1. FIG. 4 is a diagram showing a section of the crankcase 200 along the front-rear direction and the upper-lower direction when viewed from the right side toward the left side. As with FIG. 2, FIG. 4 shows the region A1. As shown in FIG. 4, the internal combustion engine 100 includes: a scavenging pump 910 that supplies the oil in the crank chamber 231 to the oil sump chamber 232; and a feed pump 920 that supplies the oil in the oil sump chamber 232 to the crank chamber 231. The scavenging pump 910 communicates with the supply port 232*a*. The feed pump 920 is connected to the nozzle 901 through a pipe.

The scavenging pump 910 and the feed pump 920 are located so as to overlap each other in an extending direction of the crankshaft 400, i.e., in the left-right direction. In the present embodiment, each of the scavenging pump 910 and the feed pump 920 has the structure of an internal gear pump. However, the present embodiment is not limited to this. Each of the scavenging pump 910 and the feed pump 920 includes: an outer rotor Ro including an internal gear; an inner rotor Ri including an external gear and located inside the outer rotor Ro; and a drive shaft Ds that rotates the inner rotor Ri. The drive shaft Ds is located at a rotation center of the inner rotor Ri. The outer rotor Ro and the inner rotor Ri eccentrically mesh with each other. When the drive shaft Ds rotates the inner rotor Ri, the inner rotor Ri rotates the outer rotor Ro through the meshing. A space between the inner rotor Ri and the outer rotor Ro is expanded and reduced according to the rotor rotation, and thus, the oil is sucked into the space and discharged from the space.

The scavenging pump 910 and the feed pump 920 shares one drive shaft Ds. The inner rotor Ri of the scavenging pump 910 and the inner rotor Ri of the feed pump 920 are coaxially located and rotate about the drive shaft Ds. The outer rotor Ro of the scavenging pump 910 and the outer rotor Ro of the feed pump 920 are coaxially located and rotate about the same axis that is eccentric to the drive shaft Ds. The scavenging pump 910 and the feed pump 920 are made to simultaneously operate by the drive shaft Ds. The scavenging pump 910 and the feed pump 920 can pressure-feed the oil at the same flow rate and the same pressure.

The scavenging pump 910 and the feed pump 920 are located adjacent to the oil sump chamber 232 and the oil collection chamber 233 in the left-right direction. In the present embodiment, each of the scavenging pump 910 and the feed pump 920 is located at a rearward position relative to the rotation center axis of the crank journal 401. However, the present embodiment is not limited to this. The scavenging pump 910 sucks the oil in the oil collection chamber 233 and discharges the oil to the oil sump chamber 232. The scavenging pump 910 pressure-feeds the oil into a passage which is located in the first dividing wall portion 212 and communicates with the supply port 232*a*. Then, the scavenging pump 910 discharges the oil through the supply port 232*a*. The feed pump 920 sucks the oil in the oil sump chamber 232, pressure-feeds the oil to the nozzle 901, and discharges the oil through the nozzle 901. As above, a semi-dry sump system is adopted as a lubricating system of the internal combustion engine 100 of the present embodiment.

Figure 5:
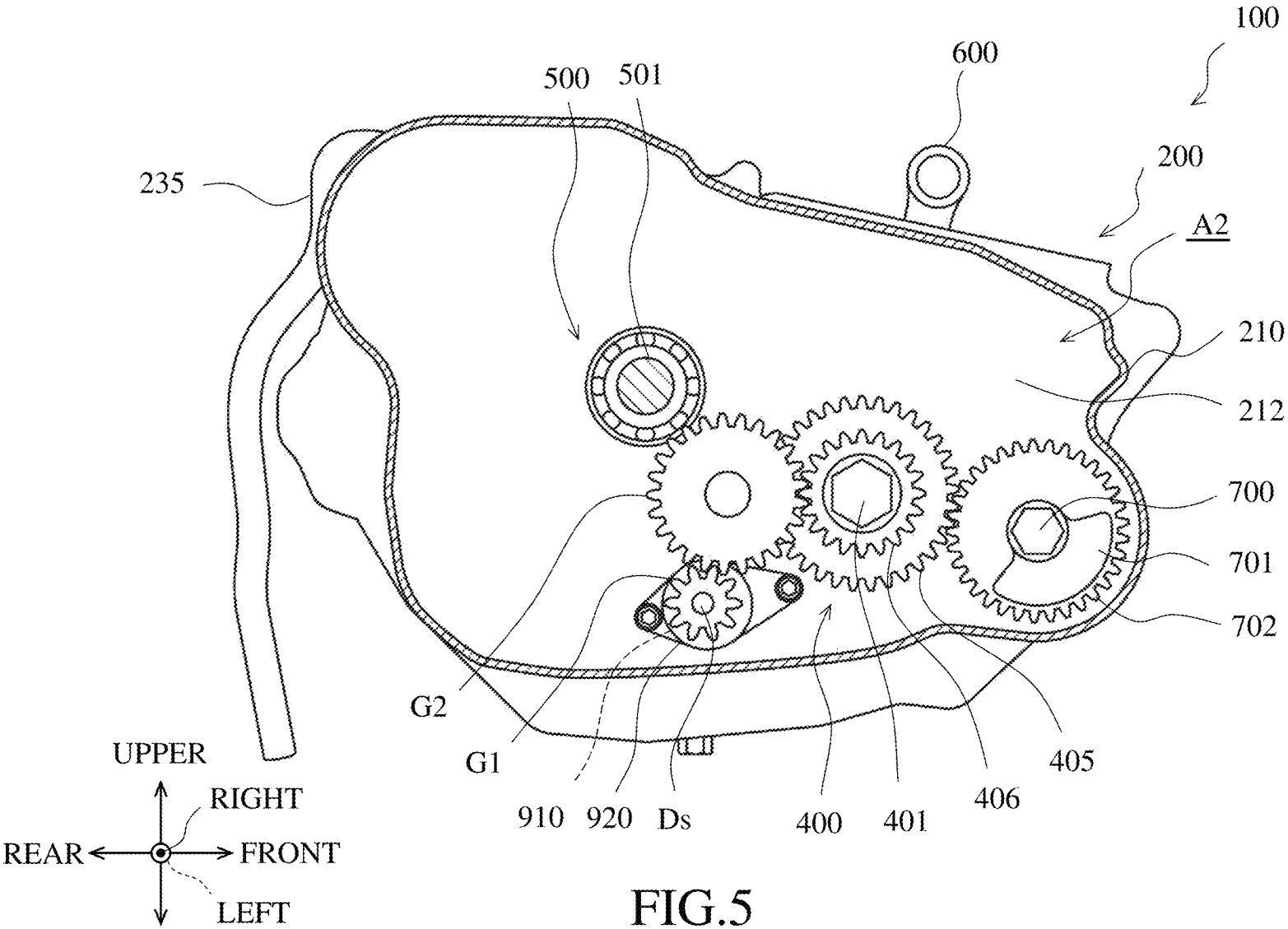
FIG. 5 is a diagram showing yet another section of the internal combustion engine of FIG. 1.

FIG. 5 is a diagram showing yet another section of the internal combustion engine 100 of FIG. 1. FIG. 5 is a diagram showing a section of the crankcase 200 along the front-rear direction and the upper-lower direction when viewed from the right side toward the left side as with FIG. 4. FIG. 5 shows a region A2 which is adjacently located at the right side of the region A1.

As shown in FIG. 5, an end portion of the crankshaft 400 includes driving gears 405 and 406 that rotate integrally with the crank journal 401. The driving gears 405 and 406 are located coaxially with the crank journal 401 and rotate about the same rotation center axis as the crank journal 401. The driving gears 405 and 406 are rotated together by the crankshaft 400. The first driving gear 405 drives the balancer shaft 700, and the second driving gear 406 drives the scavenging pump 910 and the feed pump 920.

An end portion of the balancer shaft 700 includes a driven gear 702 and the counter weight 701 which rotate integrally with the balancer shaft 700. The driven gear 702 and the counter weight 701 are located coaxially with the balancer shaft 700 and rotate about the same rotation center axis as the balancer shaft 700. The balancer shaft 700 and the counter weight 701 are rotated together by the driven gear 702. The driven gear 702 meshes with the first driving gear 405. Therefore, the balancer shaft 700, the counter weight 701, and the driven gear 702 are rotated together by the crankshaft 400 through the first driving gear 405.

In the present embodiment, the number of teeth of the driven gear 702 is equivalent to the number of teeth of the first driving gear 405. However, the present embodiment is not limited to this. Therefore, a rotational speed of the balancer shaft 700 is equivalent to a rotational speed of the crankshaft 400. Thus, the balancer shaft 700 can effectively reduce the inertial force generated at the crankshaft 400.

An end portion of the drive shaft Ds of the scavenging pump 910 and the feed pump 920 includes a driven gear G1 that rotates integrally with the drive shaft Ds. The driven gear G1 is located coaxially with the drive shaft Ds and rotates about the same rotation center axis as the drive shaft Ds. The driven gear G1 meshes with an intermediate gear G2, and the intermediate gear G2 meshes with the second driving gear 406. Therefore, the drive shaft Ds and the driven gear G1 are rotated together by the crankshaft 400 through the second driving gear 406 and the intermediate gear G2.

In the present embodiment, the number of teeth of the driven gear G1 is smaller than the number of teeth of the second driving gear 406. However, the present embodiment is not limited to this. Therefore, each of the rotational speed of the scavenging pump 910 and the rotational speed of the feed pump 920 is higher than the rotational speed of the crankshaft 400. Thus, each of the scavenging pump 910 and the feed pump 920 can pressure-feed a large supply amount of oil at high pressure.

The internal combustion engine 100 drives the balancer shaft 700, the scavenging pump 910, and the feed pump 920 by the rotational power of the crankshaft 400.

The foregoing has described the exemplary embodiment of the present disclosure. However, the present disclosure is not limited to the above embodiment. To be specific, various modifications and improvements may be made within the scope of the present disclosure. For example, embodiments prepared by variously modifying the embodiment and embodiments prepared by combining components in different embodiments are also included in the scope of the present disclosure.

For example, in the embodiment, the internal combustion engine 100 includes the filler 800 as a member different from the pipe 710 that surrounds the balancer shaft 700 from an outside. However, the present disclosure is not limited to this. For example, the filler 800 and the pipe 710 made of metal may be integrally molded so as to be formed as one member. Or, the internal combustion engine 100 may not include the pipe 710, and the filler 800 may serve as the pipe 710, specifically, the through hole 801 of the filler 800 may serve as a hole of the pipe 710.

In the embodiment, the filler 800 has such a shape as to fill all of the spaces among the front wall portion 211*a* of the outer wall portion 211, the front wall portion 213*b* of the second dividing wall portion 213, and the pipe 710. However, the present disclosure is not limited to this. For example, the filler 800 may have such a shape as to fill one or more of the above spaces.

In the embodiment, the filler 800 includes the curved surface 802 extending from the front wall portion 211*a* of the outer wall portion 211 to the front wall portion 213*b* of the second dividing wall portion 213. To be specific, the curved surface 802 extends so as to separate the entirety of a portion of the crank chamber 231, which projects forward from the occupied region AC of the crankshaft 400, from the occupied region AC. However, for example, the curved surface 802 may be a curved surface that extends so as to separate a part of the above projecting portion from the occupied region AC. The curved surface 802 may realize the smooth flow of the oil between the crankshaft 400, the curved surface 802, and the opposing wall portion 213*a*.

In the embodiment, the lubricating system of the internal combustion engine 100 is the semi-dry sump system. However, the present disclosure is not limited to this. For example, the lubricating system of the internal combustion engine 100 may be a dry-sump system. Regardless of the type of the system, the oil is pressure-fed into the crank chamber 231. Thus, the structure in which the filler 800 fills the space around the balancer shaft 700 prevents the turbulent flow of the oil around the balancer shaft 700 and is therefore useful for the improvement of the output of the internal combustion engine 100.

In the embodiment, the internal combustion engine 100 has a structure for a single cylinder but may have a structure for multiple cylinders. The filler 800 is also applicable to such internal combustion engine 100.

In the embodiment, the motorcycle 1 is a straddled vehicle including step bars at the lateral sides with respect to the seat. However, the motorcycle 1 may be a scooter vehicle including a floorboard in front of the seat.

In the embodiment, the motorcycle 1 is described as the vehicle 1 including the internal combustion engine 100. However, the present disclosure is not limited to this. The vehicle 1 may be any vehicle as long as the vehicle includes the internal combustion engine 100. For example, the vehicle 1 may have a structure for moving with one or more persons on the vehicle 1. The vehicle 1 may be controlled by a person on the vehicle 1 or may be remotely controlled from an outside of the vehicle 1. Examples of the vehicle 1 may include motorcycles, automobiles, mopeds, water vehicles, and other various mobilities. Examples of the automobiles may include passenger vehicles, freight vehicles, buses, all-terrain vehicles, and utility vehicles. Examples of the water vehicles may include freight ships, passenger ships, work ships, fishing boats, pleasure boats, and personal watercrafts.

Examples of aspects of the technology of the present disclosure are as below. An internal combustion engine for a vehicle according to a first aspect of the present disclosure includes: a crankshaft; a balancer shaft that is connected to the crankshaft and is rotated by rotational power transmitted from the crankshaft; a crankcase including a crank chamber that accommodates the crankshaft and the balancer shaft; and a filler that fills a space around the balancer shaft in the crank chamber and is a member different from a wall surrounding the crank chamber.

According to the first aspect, the filler fills the space around the balancer shaft to reduce the volume of the crank chamber. Thus, the oil in the crank chamber may be efficiently stirred by the crankshaft. Moreover, the flow of the oil stirred by the crankshaft is prevented from being disturbed by the collision with the balancer shaft. Thus, the flow of the oil in the crank chamber becomes smooth. Therefore, the stirring resistance of the oil in the crank chamber when the crankshaft rotates decreases, and this can increase the output of the internal combustion engine.

The internal combustion engine according to a second aspect of the present disclosure may be configured such that in the first aspect, the filler fills a space between the wall surrounding the crank chamber and the balancer shaft.

According to the second aspect, the flow of the oil stirred by the crankshaft is prevented from being disturbed by passing through a space between the wall of the crank chamber and the balancer shaft. Thus, the flow of the oil in the crank chamber becomes smooth.

The internal combustion engine according to a third aspect of the present disclosure may be configured such that in the first or second aspect, the filler extends in an axial direction of the balancer shaft while surrounding the balancer shaft in a circumferential direction of the balancer shaft.

According to the third aspect, the flow of the oil stirred by the crankshaft is prevented from being disturbed by the collision with the balancer shaft. Thus, the flow of the oil in the crank chamber becomes smooth.

The internal combustion engine according to a fourth aspect of the present disclosure may be configured such that in any one of the first to third aspects, the internal combustion engine further includes a pipe that surrounds the balancer shaft from an outside, extends through the crank chamber, and supports the balancer shaft such that the balancer shaft is rotatable, and the filler extends in an axial direction of the pipe while surrounding the pipe in a circumferential direction of the pipe.

According to the fourth aspect, the interference between the rotating balancer shaft and the filler is prevented. The pipe separates the balancer shaft and the space in the crank chamber. Thus, even when the filler has such a shape as to expose part of the pipe, the rotation of the balancer shaft is prevented from influencing the flow of the oil in the crank chamber.

The internal combustion engine according to a fifth aspect of the present disclosure may be configured such that in any one of the first to fourth aspects, the filler includes a curved surface that is opposed to an outer circumferential portion of an occupied region of the crankshaft and extends along this outer circumferential portion, the occupied region being a region through which a counter weight included in the crankshaft passes by rotation of the crankshaft.

According to the fifth aspect, the oil stirred by the crankshaft can smoothly flow through a space between the crankshaft and the curved surface of the filler. Thus, the flow of the oil in the crank chamber becomes smooth.

The internal combustion engine according to a sixth aspect of the present disclosure may be configured such that in the fifth aspect, the crankcase includes a wall that is opposed to the outer circumferential portion of the occupied region and extends along this outer circumferential portion.

According to the sixth aspect, the wall and the filler form curved surfaces lined up in a row, which are opposed to the outer circumferential portion of the occupied region of the crankshaft and extend along this outer circumferential portion. Such curved surfaces may define the crank chamber such that the shape and volume of the crank chamber become close to the shape and volume of the occupied region. Thus, the flow of the oil in the crank chamber becomes smooth.

The internal combustion engine according to a seventh aspect of the present disclosure may be configured such that in any one of the first to sixth aspects, the crankcase includes a wall that surrounds the crank chamber and includes metal, and the filler includes resin that is lower in density than the metal included in the wall.

According to the seventh aspect, when the space around the balancer shaft which is to be filled is filled with the filler, the internal combustion engine can be made lighter than when the space is filled with the same material as the wall of the crankcase or when the space is divided by a dividing wall made of the same material as the wall of the crankcase.

The internal combustion engine according to an eighth aspect of the present disclosure may be configured such that in any one of the first to seventh aspects, the crankcase further includes an oil sump chamber that stores oil, and the internal combustion engine further includes: a scavenging pump that supplies the oil in the crank chamber to the oil sump chamber; a feed pump that supplies the oil in the oil sump chamber to the crank chamber; and a nozzle that is connected to the feed pump and is located so as to discharge the oil, supplied from the feed pump, into the crank chamber.

According to the eighth aspect, the internal combustion engine includes a semi-dry sump structure by which oil is forcibly supplied to a crank chamber by a feed pump. Therefore, the flow of the oil in the crank chamber tends to be disturbed. However, the filler can prevent the flow of the oil from being disturbed.

The internal combustion engine according to a ninth aspect of the present disclosure may be configured such that in the eighth aspect, the filler includes a curved surface that is opposed to an outer circumferential portion of an occupied region of the crankshaft and extends along this outer circumferential portion, the occupied region being a region through which a counter weight included in the crankshaft passes by rotation of the crankshaft, and the nozzle is located in the vicinity of the filler and is directed so as to discharge the oil in a direction that extends along the curved surface.

According to the ninth aspect, the oil stirred by the crankshaft may flow along the curved surface of the filler. Moreover, the oil is discharged from the nozzle in a direction that extends along the curved surface of the filler. Therefore, the oil stirred by the crankshaft and the oil discharged from the nozzle can smoothly flow while being mixed with each other. Thus, the flow of the oil in the crank chamber becomes smooth.

The internal combustion engine according to a tenth aspect of the present disclosure may be configured such that in the eighth or ninth aspect, the balancer shaft and the filler are located at forward positions relative to a rotation center axis of the crankshaft in the vehicle, and the scavenging pump and the feed pump are located at rearward positions relative to the rotation center axis of the crankshaft in the vehicle.

According to the tenth aspect, a portion of the internal combustion engine which is located at a downward position relative to the crankshaft can be made compact. Thus, the road clearance of the vehicle is easily secured.

A vehicle according to an eleventh aspect of the present disclosure includes: wheels; an internal combustion engine that includes a crankshaft and outputs rotational power of the crankshaft; and a driving structure that is connected to the crankshaft and transmits the rotational power of the crankshaft to one or more of the wheels, wherein the internal combustion engine includes a balancer shaft that is connected to the crankshaft and is rotated by the rotational power transmitted from the crankshaft, a crankcase including a crank chamber that accommodates the crankshaft and the balancer shaft, and a filler that fills a space around the balancer shaft in the crank chamber and is a member different from a wall surrounding the crank chamber.

According to the eleventh aspect, the vehicle having the same effects as the internal combustion engine according to one aspect of the present disclosure is obtained.

The vehicle according to a twelfth aspect of the present disclosure may be configured such that in the eleventh aspect, the vehicle is a straddled off-road traveling vehicle, the driving structure includes a transmission mounted inside the crankcase, the transmission is located so as not to project in a lower direction of the vehicle beyond an occupied region of the crankshaft, the occupied region being a region through which a counter weight included in the crankshaft passes by rotation of the crankshaft, and the balancer shaft and the filler are located at forward positions relative to a rotation center axis of the crankshaft in the vehicle and are located so as not to project in the lower direction of the vehicle beyond the occupied region.

According to the twelfth aspect, since the transmission, the balancer shaft, and the filler are located as above, a portion of the internal combustion engine which is located at a downward position relative to the occupied region of the crankshaft can be made compact. Therefore, a large road clearance required for a straddled off-road traveling vehicle can be secured.

All of the numerals used herein, such as the ordinal numbers and those indicating quantities, are examples used to specifically describe the technology of the present disclosure, and the present disclosure is not limited to those example numerals. Connection relationships among the components herein are mere examples to specifically describe the technology of the present disclosure, and connection relationships that realize the functions of the present disclosure are not limited to these examples.

As the present disclosure may be embodied in various forms without departing from the scope of the essential features thereof, the illustrative embodiment and variations are therefore illustrative and not restrictive, since the scope of the present disclosure is defined by the appended claims rather than by the description preceding them. All changes that fall within metes and bounds of the claims, or equivalence of such metes and bounds thereof are therefore intended to be embraced by the claims.

What is claimed is:

1. An internal combustion engine for a vehicle, the internal combustion engine comprising:

a crankshaft;

a balancer shaft that is connected to the crankshaft and configured to be rotated by rotational power transmitted from the crankshaft;

a crankcase including a crank chamber that accommodates the crankshaft and the balancer shaft; and a filler that fills a space around the balancer shaft in the crank chamber and is a member different from a wall surrounding the crank chamber, wherein:

the crankcase includes the wall and includes metal; and the filler includes resin that is lower in density than the metal included in the wall.

2. The internal combustion engine according to claim 1, wherein the space is between the wall and the balancer shaft.

3. The internal combustion engine according to claim 1, wherein the filler extends in an axial direction of the balancer shaft while surrounding the balancer shaft in a circumferential direction of the balancer shaft.

4. The internal combustion engine according to claim 3, further comprising a pipe that surrounds the balancer shaft from outside, extends through the crank chamber, and supports the balancer shaft such that the balancer shaft is rotatable, wherein the filler extends in an axial direction of the pipe while surrounding the pipe in a circumferential direction of the pipe.

5. The internal combustion engine according to claim 1, wherein:

the filler includes a curved surface that is opposed to an outer circumferential portion of an occupied region of the crankshaft and extends along the outer circumferential portion of the occupied region of the crankshaft; and the occupied region of the crankshaft is a region through which a counter weight included in the crankshaft is configured to pass by rotation of the crankshaft.

6. The internal combustion engine according to claim 5, wherein:

the wall is a first wall; and the crankcase includes a second wall that is opposed to the outer circumferential portion of the occupied region of the crankshaft and extends along the outer circumferential portion of the occupied region of the crankshaft.

7. The internal combustion engine according to claim 1, wherein:

the crankcase further includes an oil sump chamber that is configured to store oil; and the internal combustion engine further comprises:

a scavenging pump that is configured to supply the oil in the crank chamber to the oil sump chamber;

a feed pump that is configured to supply the oil in the oil sump chamber to the crank chamber; and a nozzle that is connected to the feed pump and configured to discharge the oil, supplied from the feed pump, into the crank chamber.

8. The internal combustion engine according to claim 7, wherein:

the filler includes a curved surface that is opposed to an outer circumferential portion of an occupied region of the crankshaft and extends along the outer circumferential portion of the occupied region of the crankshaft;

the occupied region of the crankshaft is a region through which a counter weight included in the crankshaft is configured to pass by rotation of the crankshaft; and the nozzle is located in the vicinity of the filler and configured to discharge the oil in a direction that extends along the curved surface.

9. The internal combustion engine according to claim 7, wherein:

the balancer shaft and the filler are configured to be located at forward positions relative to a rotation center axis of the crankshaft in the vehicle; and the scavenging pump and the feed pump are configured to be located at rearward positions relative to the rotation center axis of the crankshaft in the vehicle.

10. A straddlable off-road travelable vehicle comprising:

wheels;

an internal combustion engine that includes a crankshaft and is configured to output rotational power of the crankshaft; and a driving structure that is connected to the crankshaft and configured to transmit the rotational power of the crankshaft to at least one of the wheels, wherein the internal combustion engine further includes:

a balancer shaft that is connected to the crankshaft and configured to be rotated by the rotational power transmitted from the crankshaft;

a crankcase including a crank chamber that accommodates the crankshaft and the balancer shaft; and a filler that fills a space around the balancer shaft in the crank chamber and is a member different from a wall surrounding the crank chamber, and wherein:

the driving structure includes a transmission mounted inside the crankcase;

the transmission is located so as not to project in a lower direction of the straddlable off-road travelable vehicle beyond an occupied region of the crankshaft;

the crankshaft includes a counterweight that is configured to pass through the occupied region of the crankshaft by rotation of the crankshaft; and the balancer shaft and the filler are located: (i) at forward positions relative to a rotation center axis of the crankshaft in the straddlable off-road travelable vehicle; and (ii) so as not to project in the lower direction of the straddlable off-road travelable vehicle beyond the occupied region of the crankshaft.

* * * * *